US005314632A

United States Patent [19]

Papke et al.

[11] Patent Number: 5,314,632

[45] Date of Patent: May 24, 1994

[54] COMBINING DISPERSANT VISCOSITY INDEX IMPROVER AND DETERGENT ADDITIVES FOR LUBRICANTS

[75] Inventors: Brian L. Papke; Issac D. Rubin, both of Wappingers Falls; John Castrogiovanni, Jr., Milton, all of N.Y.

[73] Assignee: Texaco Inc., White Plains, N.Y.

[21] Appl. No.: 894,390

[22] Filed: Jun. 5, 1992

[51] Int. Cl.[5] ..... C10M 135/10; C10M 133/58

[52] U.S. Cl. ..... 252/18; 252/33.0; 252/50

[58] Field of Search ..... 252/50, 18

[56] References Cited

U.S. PATENT DOCUMENTS

| | | | |
|---|---|---|---|
| 4,160,739 | 7/1979 | Stambaugh et al. | 252/50 |
| 4,502,971 | 3/1985 | Robson | 252/33.3 |
| 4,863,623 | 9/1989 | Nalesnik | 252/50 |
| 4,981,603 | 6/1991 | Demange | 252/33 |

OTHER PUBLICATIONS

Smalheer & Smith, "Lubricant Additives", 1967.

*Primary Examiner*—Ellen M. McAvoy

*Attorney, Agent, or Firm*—James J. O'Loughlin; Henry H. Gibson

[57] ABSTRACT

Lubricants with enhanced viscosities are made from additives by combining dispersant viscosity index polymer, like dispersancy-substituted polyolefins, and detergent, like overbased, oil-soluble, metal salts, before adding dispersant package.

13 Claims, 4 Drawing Sheets

Effect of Detergent/VI Improver Ratio on 100 C Relative Kinematic Viscosity.

Figure 1. Effect of Detergent/VI Improver Ratio on 100 C Relative Kinematic Viscosity.
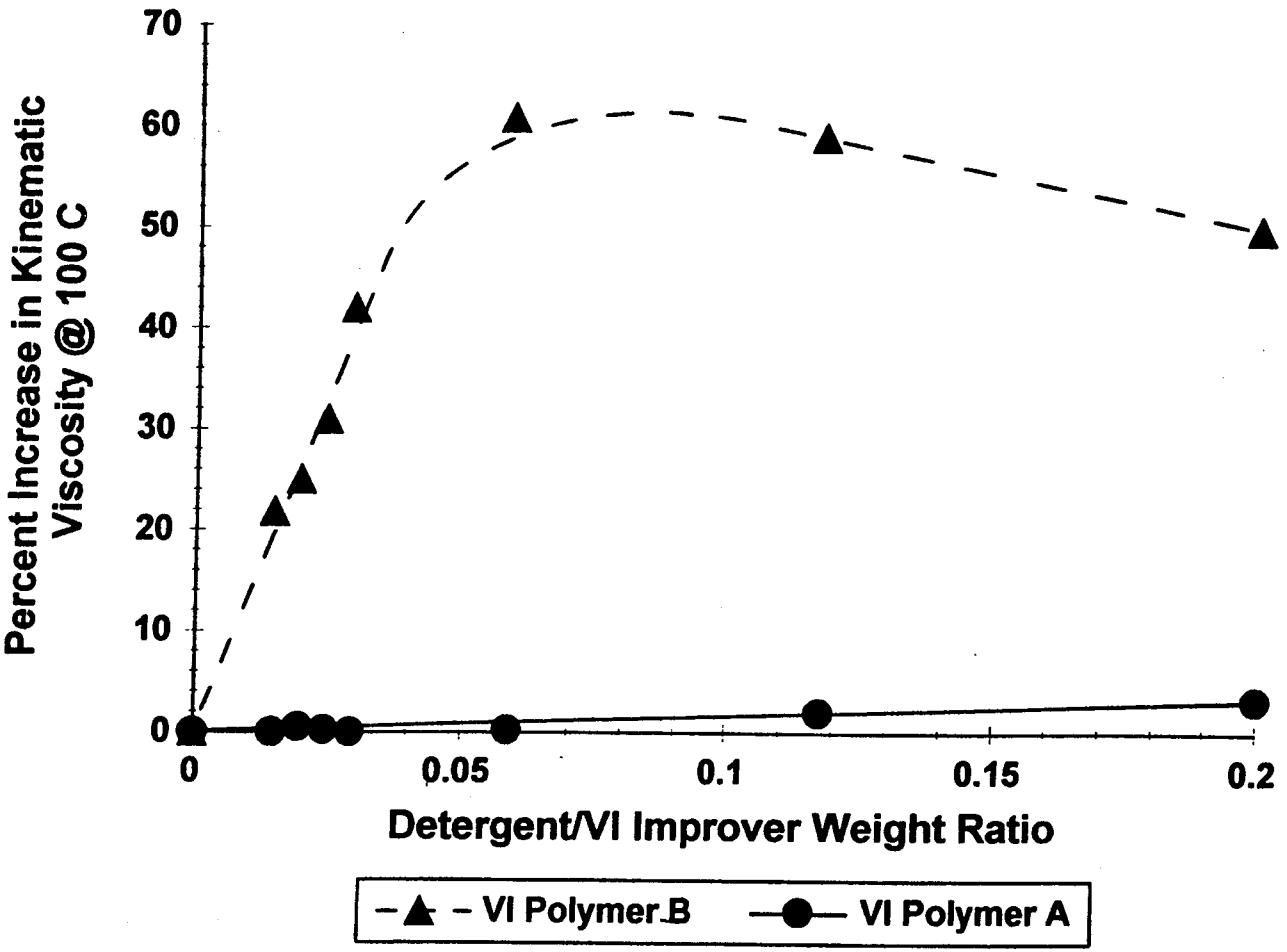

Figure 2. Effect of Detergent/VI Improver Ratio on 150 C Cannon High Shear Viscosity.
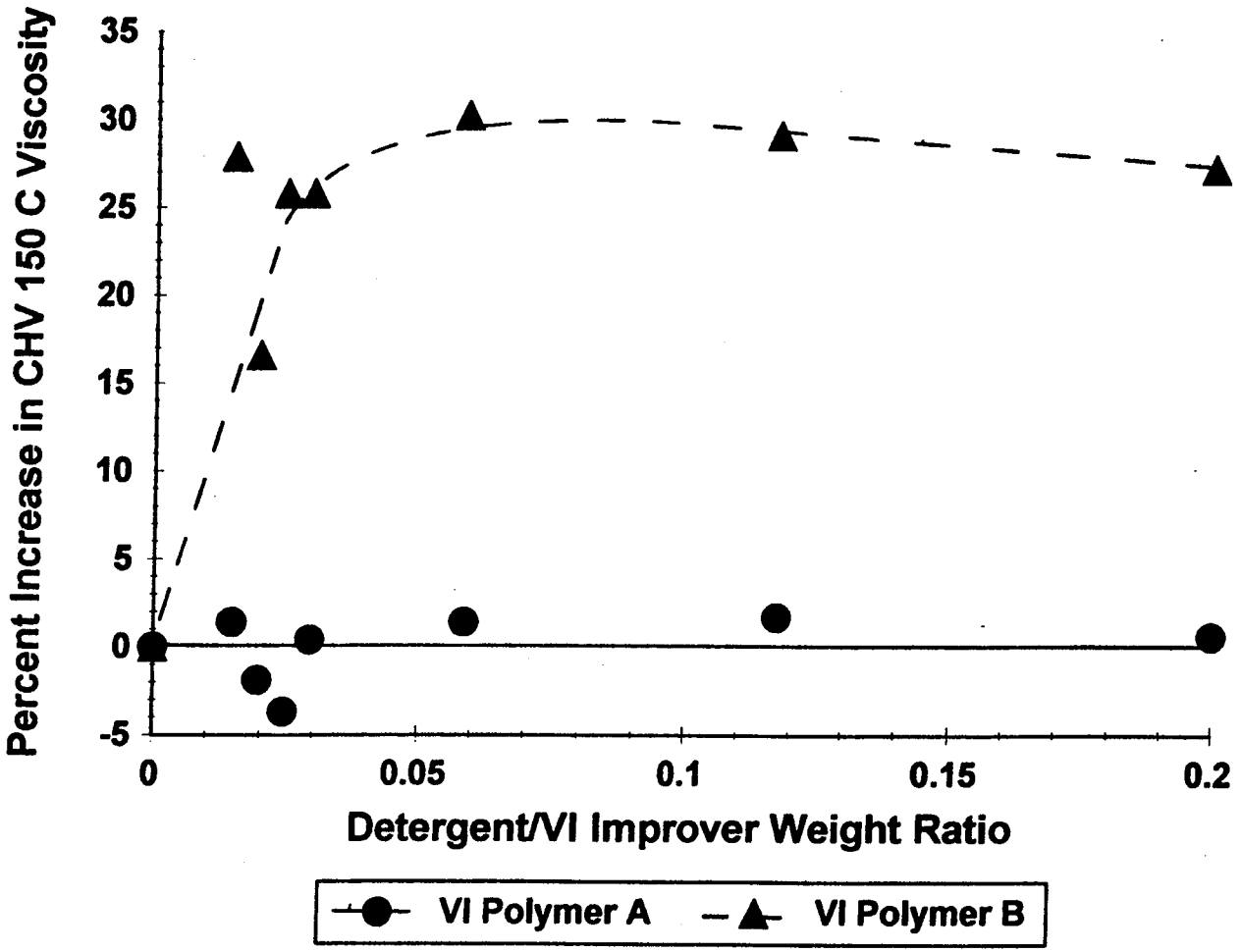

Figure 3. Effect of Detergent/VI Improver Ratio on -25 C Cold Cranking Viscosity.
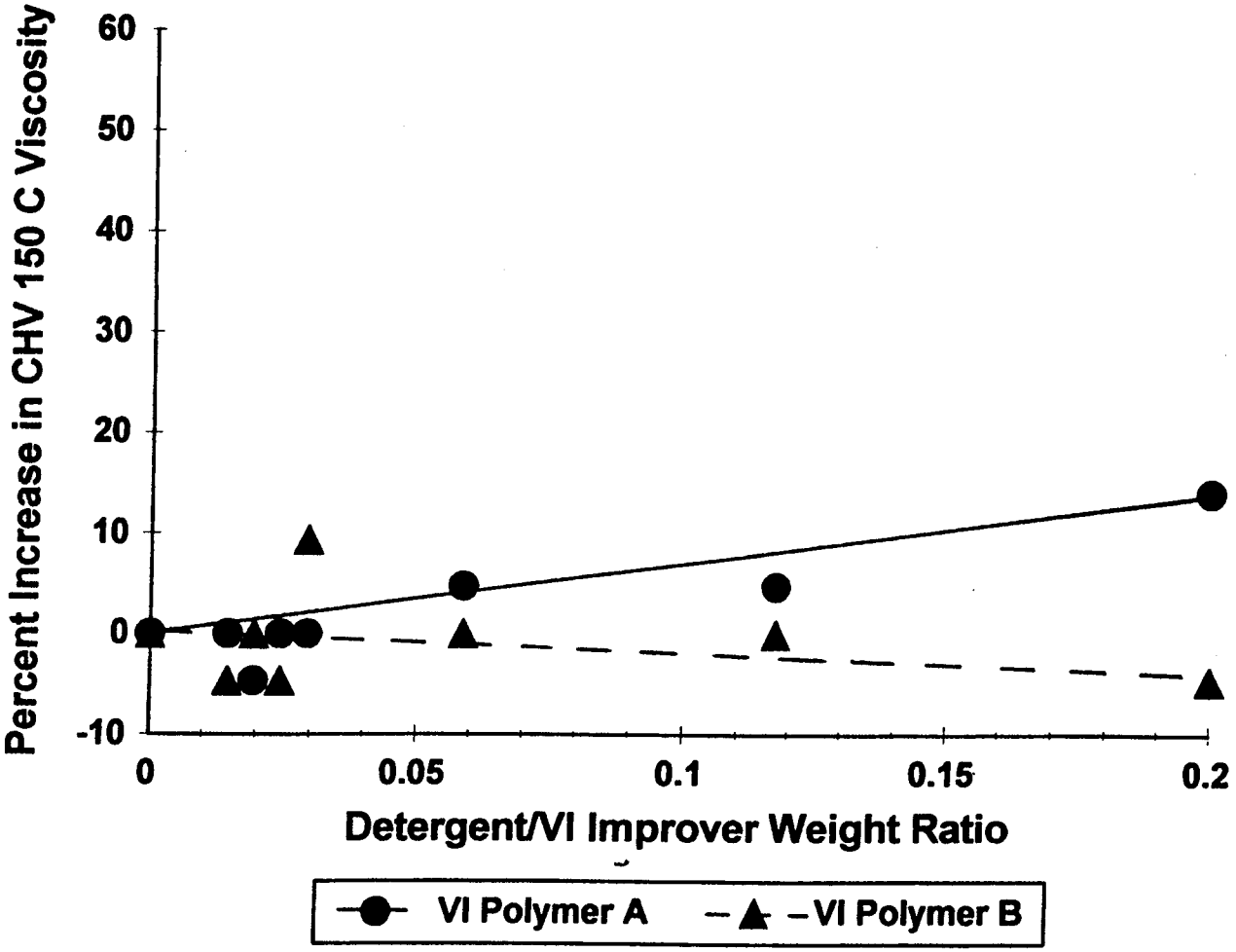

Figure 4. Viscosity Change vs Weight Percent Dispersant for Specific Premix Combinations.
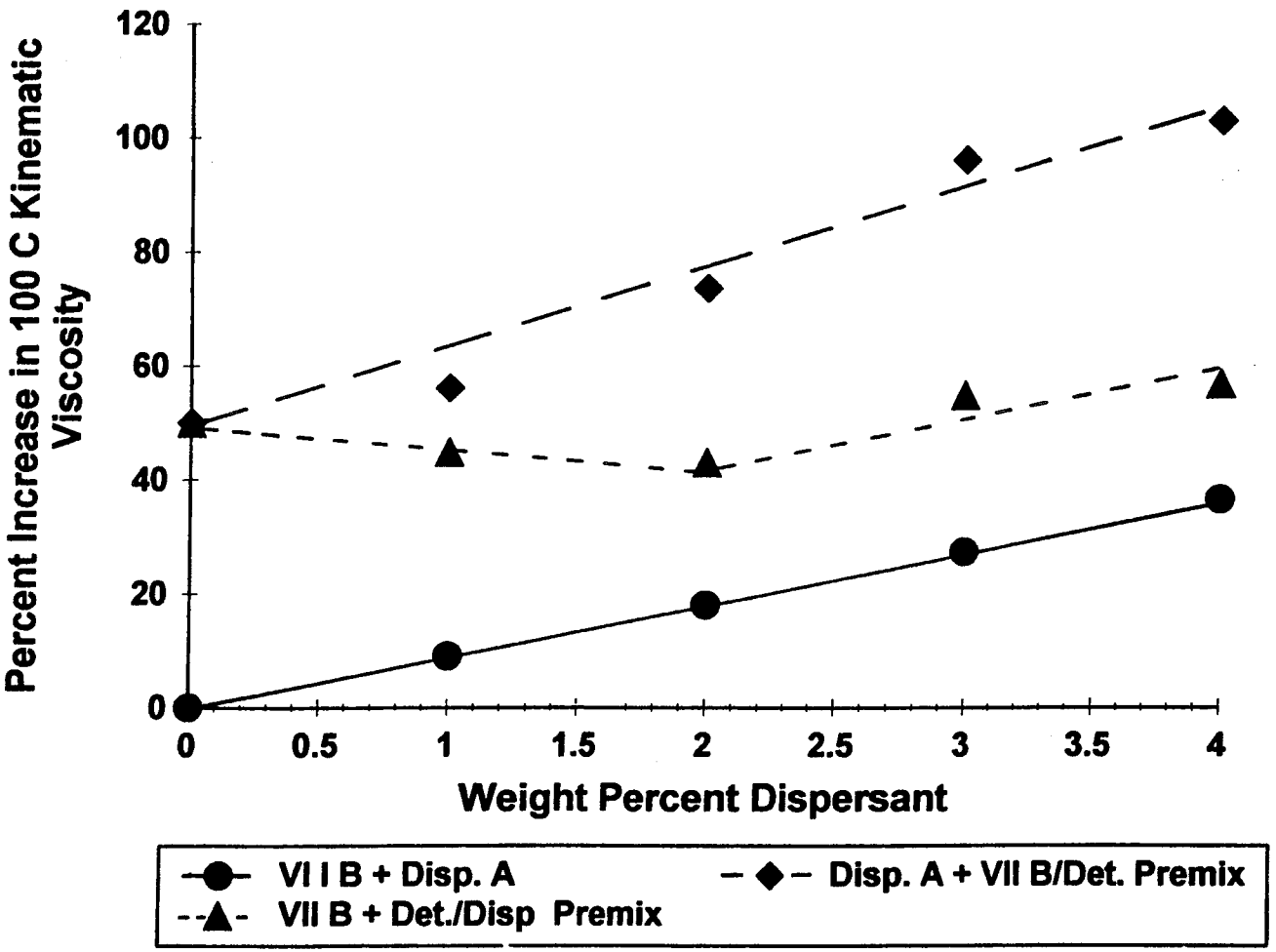

COMBINING DISPERSANT VISCOSITY INDEX IMPROVER AND DETERGENT ADDITIVES FOR LUBRICANTS

BACKGROUND OF THE INVENTION

1. Field of the Invention

This invention concerns lubricants and methods for their production. More particularly, lubricating oils having enhanced viscosity properties are made by combining certain dispersant viscosity index improver and detergent lubricant additives.

2. Description of Related Information

Lubricants play an essential role in many areas, particularly in the transportation industry. Large amounts of inexpensive lubricants are needed to keep transportation vehicles running smoothly. Mineral oils are relatively inexpensive and have been used effectively as lubricants. The use of mineral oils is, however, curtailed by the limited performance characteristics of mineral oils over the full range of temperature and conditions under which lubricants are used, such as for lubricating engines or other high speed, moving parts. Lubricants often need to have sufficient fluidity, which can be determined by measuring viscosity, over a wide temperature range. For example, engine crankcase lubricant needs to be sufficiently fluid at temperatures well below 0° C. to enable engine start-up in cold weather. Conversely, such lubricant must also have enough viscosity at high temperatures during engine operation to avoid "thinning out", which would result in loss of engine lubrication.

Synthetic oils have been developed which can operate more effectively over a wider range of conditions than mineral oils alone. Various additives have also been developed which supplement and extend lubricating oil performance. Additives called viscosity index, or "VI", improvers or modifiers, are designed to improve the viscosity of lubricants, such as by increasing, or extending, the viscosity of the lubricant at higher temperatures. For example, U.S. Pat. No. 4,863,623 (Nalesnik) describes VI improvers which are polyolefins grafted with carboxylic groups derivatized with amino-aromatic polyamine. This VI improver also provides dispersancy and anti-oxidant properties.

These and other additives, like dispersants, detergents, anti-foamants, various inhibitors and more, are used to expand the utility of lubricants for differing applications. When used in combination, the additives and lubricants can interact in ways that change the properties and usefulness of the lubricant composition. For example, some dispersants and detergents have limited compatibility, such as disclosed in U.S. Pat. No. 4,502,971 (Robson) which describes mixtures of dispersants and magnesium detergents having increased viscosity which is reduced by prereacting dispersant with alkali metal salt. Similarly, U.S. Pat. No. 4,981,603 (Demange) describes a process for improving the compatibility of dispersants and magnesium detergents by premixing dispersant, detergent and solvent to eliminate haze and sediment.

Synthetic oils and additives, however, add significantly to the expense of lubricants. It would therefore be highly desirable if a lubricant can be made which maximizes the use of relatively inexpensive, mineral oils and minimizes the use of more expensive synthetic oils and additives, and which also gives more effective lubricant performance, such as better fluidity, over a wide range of temperatures and conditions.

SUMMARY OF THE INVENTION

This invention concerns a process for making a lubricant composition. The process involves combining dispersant VI polymer with detergent to make a premix. The dispersant VI polymer is a polyolefin of ethylene, $C_{3-20}$ α-monoolefin, and optionally polyene, having a number average molecular weight of at least about 10,000, which is grafted with ethylenically unsaturated, carboxyl-containing compound and dispersancy substituent. The detergent is an overbased, oil soluble, metal salt. Lubricating oil and dispersant package are then combined with the premix to make a lubricant composition with enhanced viscosification.

Lubricant compositions made by such processes are also provided.

Viscosifying compositions comprising the premix in lubricating oil and which is essentially free of low molecular weight dispersant and having enhanced lubricant viscosification properties are also provided.

BRIEF DESCRIPTION OF THE DRAWINGS

The accompanying drawings present graphs showing viscosity performance properties of this invention.

DETAILED DESCRIPTION OF THE INVENTION

This invention enables the production of lubricants based on inexpensive mineral oils having enhanced viscosities using lower amounts of additives. These improvements are provided by a simple and inexpensive procedure involving the precombination of particular additives.

The lubricant composition comprises, and preferably consists essentially of, four parts: (1) lubricating oil; (2) VI improver; (3) detergent and (4) dispersant package, which may have lubricant additives other than dispersant.

The lubricating oil may be any, including known, material which has lubricating properties. The lubricating oil may be natural or synthetic, as well as mixtures of each. The lubricating oil may be unrefined compounds obtained directly from a natural or synthetic source, refined compounds from natural or synthetic sources which are treated in one or more purification steps, such as to improve one or more properties, or re-refined compounds from the reprocessing of used lubricants, as well as mixtures of unrefined, refined and/or re-refined compounds. Typical natural lubricating oils include, among others, one or mixtures of the following: liquid petroleum oils and hydrorefined, solvent-treated or acid-treated mineral lubricating oils, including paraffinic and/or naphthenic compounds such as N-100 Pale Oil from Texaco Inc. and SNO-100 and SNO-150 from Texaco Inc.; and the like. Typical synthetic lubricating oils include, among others, one or mixtures of the following: polyalphaolefins such as EMERY® 3004 and 3006 PAO Basestocks from Quantum Chemical Corp. and MOBIL® SHF-42 from Mobil Chemical Co.; diesters such as EMERY® 2960 and 2971 Synthetic Lubricant Basestocks from Quantum Chemical Corp. and MOBIL® Esters DB-41 and DB-51 from Mobil Chemical Co.; polyol esters, such as made by reacting dicarboxylic acids, glycols and either monobasic acids or monohydric alcohols, like EMERY® 2936 Synthetic Lubricant Basestocks from Quantum Chemical Corp. and MOBIL® Ester P-24 from Mobil Chemical Co.; silicone oils; and the like.

The viscosity improver is a polyolefin having substituents giving the polymer dispersancy properties, generally including the ability to maintain materials suspended in lubricant compositions thereby reducing undesirable precipitation or deposition. The polyolefin is a graft co-, ter- or higher polymer generally prepared by polymerizing ethylene, $C_{3-20}$ α-monoolefin and optionally polyene monomers. The polyolefin may optionally contain other repeating units, such as derived from other ethylenically unsaturated compounds, to the extent they do not significantly diminish the properties of the polyolefin as used in this invention. Typical α-monoolefins include, among others, one or mixtures of the following: propylene, 1-butene, 1-pentene, and so on. A preferred α-monoolefin is propylene.

The optional polyene is generally one or more non-conjugated diene or triene. Dienes will typically have from about 5 to about 14 carbon atoms and may be acyclic or cyclic, including bicyclic. Typical dienes include, among others, one or mixtures of the following: 1,4-hexadiene; 1,4-cyclohexadiene; dicyclopentadiene; 5-ethylidene-2-norbornene; 5-methylene-2-norbornene; 1,5-heptadiene; 1,6-octadiene; and the like. A preferred diene is 1,4-hexadiene. Trienes, which have at least two non-conjugated double bonds, typically have up to about 30 carbon atoms. Typical trienes include, one or mixtures of the following: 1-isopropylidene-3a,4,7,7a-tetrahydroindene; 1-isopropylidenedicyclopentadiene; dehydroisodicyclopentadiene; 2-(2-methylene-4-methyl-3-pentenyl) [2.2.1]bicyclo-5-heptene; and the like. The polyene reactants provide more complex polymer structures, often designated as interpolymers, which can contain crosslinks within and/or among the polyolefin molecules.

The ethylenically unsaturated, carboxyl-containing compound which is grafted onto the polyolefin may be one or mixtures of compounds having at least one ethylenic unsaturation, i.e.

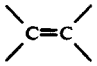

group, and at least one, preferably two, carboxylic groups including acid, anhydride, salt, ester or other derivative which is convertible into such groups, such as by oxidation or hydrolysis. Preferably, the ethylenically-unsaturated, carboxyl-containing compound is a mono- or diethylenically unsaturated, alkanoic acid or alkanedioic acid, anhydride or monoester. Typical ethylenically-unsaturated, carboxyl-containing compounds include, among others, one or mixtures of the following: alkanedioic acids or anhydrides such as 1,4-butanedioic (maleic or fumaric) acid or anhydride, methylenebutanedioic (methylenesuccinic) acid or anhydride, and the like, or their monoesters; alkenoic acids having one or more ethylenic unsaturations such as propenoic (acrylic), 2-methylpropenoic (methacrylic), 2-butenoic (crotonic), 2,4-hexadienoic (sorbic); and the like. Maleic anhydride is preferred.

The ethylenically-unsaturated, carboxylic-containing compounds may be grafted onto the polyolefin backbone by any suitable, including known, manner. For example, the compound may be grafted onto the backbone by a thermal process, such as the "ene" process, by grafting, such as in solution or solid form, using a free-radical initiator, or any other manner for grafting the compound onto the polymer. Typical procedures are described, for example, in U.S. Pat. No. 4,863,623 (Nalesnik), which is incorporated herein by reference.

The dispersancy substituent is any one or differing groups, which form part of some or all of the polyolefin grafts, giving the polyolefin dispersancy properties. Generally, the dispersancy substituent has a polar or hydrophilic component. The dispersancy substituent is the portion of the graft which is obtained by reacting one or more dispersancy compounds with the carboxyl-containing substituent grafted to polyolefin. Dispersancy compounds are materials having a polar or hydrophilic component and a functional group which is reactive with the carboxyl-containing substituent. The dispersancy compound may be any compound which gives the polyolefin dispersancy proprieties when attached to the polyolefin. Typical dispersancy compounds include, among others, one or mixtures of the following: amino-aromatic polyamines like N-arylphenylenediamines, aminophenothiazines, aminopiperazines, aminothiazoles, aminocarbazoles, aminoindoles, aminopyrroles, aminoindazolinones, aminomercaptotriazoles, aminoperimidines, aminoalkylthiothiazoles, aminodiazoles; and the like. Preferred dispersancy compounds include: N-phenyl-1,4-phenylenediamine, 2-aminoethyl-phenothiazine, N-(2-aminoethyl)piperazine, and the like.

The dispersancy compound may be reacted with the graft polyolefin by any effective, including known, procedure. Illustrative procedures are described, for example, in U.S. Pat. No. 4,863,623 (Nalesnik)

The substituted polyolefin may be obtained from any suitable, including known, source, or may be made by any effective, including known, procedure, such as described in U.S. Pat. No. 4,863,623 (Nalesink), U.S. patent application Ser. No. 07/739,547 filed Aug. 2, 1991 (Mishra et al.) or U.S. patent application Ser. No. 07/801,220 filed Dec. 2, 1991 (Mishra et al.). Preferred polyolefins include those available as TLA-510A, TLA-525 and TLA-6900 from Texaco Chemical Co.

The polyolefin VI improver is a polymer which can have a structure made of the repeating units as shown in Formula 1, or like material.

$$(-CH_2CH_2-)_a(-\overset{R}{\overset{|}{C}}HCH_2-)_b(-\overset{R_{ene}}{\overset{|}{C}}HCH_2-)_c(-\overset{R'}{\overset{|}{C}}H\overset{R_g}{\overset{|}{C}}H-)_d$$

Formula 1. VI Improver

In Formula 1, the average proportion of repeating units is given by the variables a, b, c, and d which total 100 mole percent. The amount of ethylene repeating units, given by a, is generally from about 15 to about 85, preferably from about 25 to about 80, and most preferably from about 55 to about 80, mole percent. The amount of higher alkylene repeating units, given by b, is generally from about 15 to about 85, preferably from about 20 to about 75, and most preferably from about 20 to about 45, mole percent. The amount of optional polyene repeating units, given by c, is generally from 0 to about 15, and if present is preferably from about 0.1 to about 10, and most preferably from about 0.2 to about 5, mole percent. The amount of repeating units containing one or more dispersancy substituents, given by d, is any amount which provides the polymer with dispersant properties and is generally from about 0.1 to about 15, preferably from about 0.2 to about 10, and most preferably from about 0.2 to about 5, mole percent.

In Formula each R group is independently $C_{1-18}$ alkyl, and is derived from the $C_{3-20}$ α-monoolefin reactant. Typical R groups include, among others, one or more of the following: methyl, ethyl, and so on. R is preferably methyl. Each $R_{ene}$ group is independently $C_{2-30}$ hydrocarbenyl, or a hydrocarbyl or hydrocarbenyl crosslink to another repeating unit of the same or different polyolefin molecule and is derived from polyene reactant, if any. The term "hydrocarbenyl" is used to mean a hydrocarbyl group containing one or more ethylenic unsaturations. The term "hydrocarbyl" is used to mean a group having hydrogen and carbon atoms. The hydrocarbyl may be cyclic or acyclic, including straight- or branched-chain, saturated or unsaturated, including aromatic, and may be unsubstituted or substituted with other elements, such as oxygen, or functional groups, including polar substituents. Typical $R_{ene}$ groups include, among others, the side chain portion of any polyene-based segment of the polyolefin, such as those derived from the typical dienes and trienes described previously, including those which crosslink with other polyolefin segments, and the like. Each R' group is independently hydrogen, R or $R_{ene}$ depending on which kind of repeating unit is grafted.

Each $R_g$ in Formula 1 is independently a grafted substituent made by grafting the ethylenically unsaturated, carboxyl-containing compound onto the polyolefin. Some or all $R_g$ groups have dispersancy substituent derived from the dispersing compound. $R_g$ groups are attached to the polyolefin backbone through an ethylene segment and have at least 1, preferably 2, carboxylic groups, or corresponding derivative as previously described, and any dispersancy substituent. Preferred $R_g$ groups, excluding any dispersancy segment, are monocarboxylic- or dicarboxylic-containing alkylene or alkenylene groups, including, among others, one or mixtures of the reaction products of the typical ethylenically-unsaturated, carboxylic-containing compounds described previously. $R_g$ groups containing dispersancy substituent are typically amino-aromatic-substituted, amide-containing hydrocarbylene, preferably N-arylphenyleneimido succinylene.

Typical $R_g$groups include, among others, one or mixtures of the product of the typical carboxyl-containing hydrocarbyl grafts reacted with the typical amino-aromatic polyamine, described previously, and the like.

The sequence of repeating units in the polyolefin is not critical. The ethylene, $C_{3+}$ alkylene, and any alkenylene, may be present in any order or configuration, such as in blocks or randomly, provided, however, that the polyolefin is soluble in the lubricant, which may limit the extent of block configuration if it results in gel formation or insolubility. The location of the graft substituents is also not critical. The grafts are typically randomly distributed along the polyolefin backbone. The particular repeating structures shown in Formula 1 are only illustrative. Corresponding isomers are also intended.

The amount of dispersancy substitution is not narrowly critical so long as a sufficient amount of dispersancy substituents are present to give the polyolefin dispersancy properties. Generally, the percentage of grafts containing dispersancy substituent can range from about 40 to 100, preferably from about 70 to about 100, and most preferably from about 90 to about 100, percent.

The molecular weight of the polyolefin must be sufficient to provide viscosity improver properties when added to lubricant or other compositions. Generally, the number average molecular weight of the polyolefin is at least about 10,000, preferably from about 20,000 to about 500,000.

The detergent is an overbased, oil-soluble, metal salt. Any, including known, overbased, oil-soluble, metal salt which is useful as a detergent in lubricant composition may be used. The term "overbased" means that the compound has a stoichiometric excess of base beyond the amount required to neutralize the acid component in the detergent. The detergent is a salt complex which can have a structure as shown in Formula 2, or like material.

$$(M^{+\nu}(OH)_\nu)_m(M_3^{+\nu}{}_{-\nu}CO_3^{=})_n(M^{+\nu}Y_\nu^{-})$$

Formula 2. Detergent

In Formula 2, $M^{+\nu}$ is an alkali or alkaline earth metal cation, having a valence, given by v, of 1 or 2. Typical M cations include among others, some or mixtures of the following: magnesium, sodium, barium and, preferably, calcium. $Y^-$ is an oil-soluble anion. Typical Y include, among others, one or mixtures of the following: alkaryl sulfonates such as sulfonated, alkyl-substituted, aromatic hydrocarbons having from about 9 to about 70 or more carbon atoms, like TLA-1421 from Texaco Chemical Co., LUBRIZOL® 74 and 6477 from Lubrizol Corp., E-611 from Ethyl Corp., WITCO® C-300 and M-300 from Witco Corp. and AMOCO® 9243 from Amoco Chemical Co.; alkyl salicylates; alkyl phenates; sulfurized alkyl phenates; naphthenates, and the like. Y is preferably alkaryl sulfonate. The detergent is said to be overbased when the sum of m+n is more than about 0.5. The amount of overbasing may vary depending upon which cation and anion are used. For example, the amount of overbasing for alkaryl sulfonates generally ranges from above 0.5 up to about 30, preferably from about 5 to about 20, and most preferably from about 8 to about 12. The detergent can have a Total Base Number (TBN), defined as the milligram equivalents of potassium hydroxide per gram of product, typically ranging from about 100 to about 500.

The detergent may be provided in any suitable form, such as in diluent, including mineral oil or the like, typically at concentrations of from about 30% to about 60%, preferably from about 45% to about 55%.

The VI improver is combined with the detergent to make a VI improver/detergent premix, using any effective, including known, procedure for combining such materials. Typically, the VI improver and detergent are combined by simply mixing together in a medium, such as solvent in which the VI improver and detergent are soluble, like mineral oil, and preferably with heating, to make a premix solution. The solvent may be any effective, including known, material in which the VI improver and detergent are soluble. Typical solvents include, among others, one or mixtures of the following: lubricating oils as described, including as preferred, previously; and the like. The amount of solvent is generally at least an amount sufficient to give a solution of VI and detergent. Preferably, sufficient solvent is provided, such as may be added before or while combining the VI improver and detergent, to give a premix solution having a viscosity which is easy to handle. Additional solvent acts as diluent by reducing the viscosity of the premix solution to desirable levels. Typically, the concentration of VI improver and detergent in the solvent is from about 5% to about 100%, preferably from about 40% to about 80%, and most preferably from about 60% to about 70%.

The relative amount of VI improver to detergent in the premix may be any amount effective at producing enhanced lubricant viscosification. The relative weight ratio of VI improver to detergent is generally at least about 1:1, preferably from about 7:1 to about 125:1, and most preferably from about 10:1 to about 60:1.

The dispersant package contains dispersant and optionally one or more other lubricant additives. The dispersant may be any, including known, material effective as a dispersant for lubricant compositions, such as by suspending oil insoluble materials, as may result from oxidation, in the lubricant to prevent their flocculation, precipitation, deposition, and also sludge formation. Dispersants which are distinct from dispersant VI improvers generally have low molecular weight of up to about 10,000, preferably from about 1,000, to about 8,000, and most preferably from about 2,000 to about 8,000. Typical dispersants include, among others, one or mixtures of the following: alkyl succinimides like the product of oil-soluble, polyisobutylene succinic anhydride reacted with ethylene amine and derivatives thereof like borate salts; polyalkenyl, especially polyisobutenyl, succinimides and derivatives thereof like Mannich phenol coupled glycamides; polyol esters of hydrocarbon-substituted, especially polyisobutenyl, succinic anhydride and derivatives thereof like oxazolines made with disubstituted amino alcohols; and the like. Preferred dispersants include: polyisobutenyl succinimides alone or combined with other lubricant additives.

Dispersant packages generally contain a concentrated mixture of dispersant and any other lubricant additives, except generally the viscosity improver, due to viscosity constraints. Active ingredients in the dispersant package are present in collective amounts of typically from about 2.5% to about 90%, preferably from about 15% to about 75%, and most preferably from about 25% to about 60%, in appropriate proportions, with the remainder being diluent or lubricating oil.

Other materials may optionally be included in the lubricant composition, such as in the dispersant package or separately. These materials include, among others, one or mixtures of the following. Other VI improvers can be added, such as polyolefins like TLA-525 from Texaco Chemical Co., dispersant polyolefins like TLA-7200 from Texaco Chemical Co., polymethacrylates like TLA-374 from Texaco Chemical Co., hydrogenated polyisobutylene star polymers like SHELLVIS® 250 from Shell Chemical Co., and the like. Other detergents can be added, such as oil soluble surfactants including compounds similar to the previously described overbased detergents without overbasing, such as where m+n in Formula 2 is less than or equal to about 0.5; and the like. Corrosion inhibitors can be added, such as any material effective at reducing degradation of metal contacted by the lubricant, like: phosphosulfohydrocarbons, meaning hydrocarbons containing phosphorus and sulfur, such as made by reacting hydrocarbon, such as terpene with phosphorus sulfide using any effective, including known, procedure; borate esters; thiadiazoles such as derivatives of 2,2-dimercapto-1,3,4-thiadiazole and benzotriazoles; and the like. Antioxidants can be added, such as any material effective in reducing lubricant deterioration from oxidation, like: dihydrocarbyl dithiophosphate metal salts; copper salts; aromatic amines like alkylated diphenylamines and phenyl alpha naphthylamine; hindered phenols; alkaline earth metal salts of alkylphenolthioesters like calcium nonylphenol sulfide, barium t-octylphenylsulfides, dioctylphenyl-amine, phosphosulfurized or sulfurized hydrocarbons; and the like. Pour point depressants can be added, such as any material effective at lowering the temperature at which the lubricant flows or can be poured, including: dialkylfumarate vinyl acetate copolymers; polymethacrylates; wax naphthalene; and the like. Anti-foamants can be added, such as any material which reduces lubricant foaming, including: polysiloxanes like silicone oil and polydimethyl siloxane; and the like. Antiwear agents can be added, such as any material effective at reducing the wear of material contacted by the lubricant, including: dihydrocarbyl dithiophosphate metal salts as described previously; borate esters and thiadiazoles as previously described; and the like. Friction modifiers can be added, such as any material influencing the friction characteristics of the lubricant, like: automatic transmission fluids; fatty acid esters and amides; glycerol esters of dimerized fatty acids; and the like. Any other materials useful in lubricant compositions can also be added.

The amount of lubricating oil, VI improver, detergent, dispersant package and any other ingredients in the lubricant composition is generally any effective, including known, amount for each component which is useful in lubricant compositions. Typically, the active amount of each component, based on the weight percent of the lubricant composition totalling 100%, is: from about 0.01% to about 15%, preferably from about 0.01% to about 4%, VI improver; from about 0.01% to about 20%, preferably from about 0.01% to about 3%, detergent; from 0.1 to about 20%, preferably from about 0.1% to about 8%, dispersant; from 0% to about 5%, preferably from about 0.01% to about 1.5% corrosion inhibitor; from 0% to about 5%, preferably from about 0.01% to about 1.5% oxidation inhibitor; from 0.1% to about 5%, preferably from about 0.0i% to about 1.5% pour point depressant; from 0% to about 3%, preferably from about 0.001% to about 0.15% anti-foamant; from 0% to about 5%, preferably from about 0.001% to about 1.5% anti-wear agent; from 0% to about 5%, preferably from about 0.01% to about 1.5% friction modifier; with the balance of one or more lubricating oils.

Viscosifying compositions, wherein dispersant is not essential, comprise the VI improver and detergent and are essentially free of low molecular weight dispersant, meaning that the composition does not contain an amount of low molecular weight dispersant which adversely impacts the performance of the VI improver and detergent combination, such as may be shown by a reduction in high temperature viscosity properties of lubricating compositions containing such additives. The low molecular weight dispersant can be a dispersant as previously described which has a molecular weight of less than about 15,000, preferably from about 1,000 to about 10,000, and most preferably from about 2,000 to about 10,000.

The VI improver/detergent premix may be combined with the lubricating oil by any effective, including known, procedure. Typically, the premix, dispersant package, and any other ingredients, are added to the lubricating oil with stirring. The mixture is usually heated to assist solubilization of the additives in the lubricating oil. Typically, the temperature may range from about 20° C. to about 100° C., preferably from about 20° C. to about 80° C., and most preferably from about 50° C. to about 80° C.

The additives and lubricant compositions can be used wherever lubricants or viscosifiers are useful, such as: in crank case lubricating oils, including for spark-ignited and compression-ignited internal combustion engines; gas engines; turbines; automatic transmission fluids; gear lubricants; metal-working lubricants; hydraulic fluids; other lubricating oil and grease compositions; or any other areas in which the compositions may be useful, such as motor fuel compositions and additives.

Lubricant compositions made by precombining VI improver and detergent have enhanced lubricant viscosification properties. This can be shown by comparing such compositions with the same composition made without precombining the VI improver and detergent. The enhanced viscosification properties may be shown using any one or more procedures for measuring viscosity or other useful means. One procedure which may be used, for example, involves measuring the kinematic viscosity of the composition. Kinematic viscosity, or KV values, can be measured by standard procedures at any suitable temperature, typically 40° C., 100° C. or 150° C., designated as KV-40, KV-100 and KV-150, respectively. The KV values of lubricant compositions of this invention will generally significantly exceed the KV values of the same compositions made without precombining the VI improver and detergent. Lubricant compositions of this invention have enhanced viscosification properties not only by showing increased viscosities at high temperatures, but also by having relatively low viscosity under low temperature conditions. This can be shown by measuring viscosity at, for example, −20° C. or −25° C. using a Cold Cranking Simulator or similar procedure. The Cold Cranking Simulator procedure is used to determine the apparent viscosity of lubricants at low temperatures and at shear rates similar to those at start-up conditions of cold engines.

This viscosification enhancement can be in the form of increased viscosity properties under normal lubricant operating conditions. Viscosification enhancement may be shown by one or more, including known, tests which measure lubricant viscosity at high temperatures. One or more kinds of viscosity increase may be provided, such as in kinematic, high shear or other viscosity properties. High temperatures include any temperature above ambient conditions. High temperature testing is generally conducted at about 40° C. or more, such as at about 100° or 150° C.

Viscosification enhancement occurs when high temperature viscosity is more than the same viscosity measurement of a corresponding composition which differs only in the kind of VI improver or detergent or without their premixing. The amount of viscosity increase is not narrowly critical. Generally, any measurable viscosity increase can be significant. Preferably, high temperature viscosity will be at least about 2%, and frequently from about 5% to about 100% or more, above the corresponding viscosity absent, or differing in, VI improver, detergent, or premixing.

The enhanced viscosification properties produced by this invention are particularly surprising and unexpected in part since the enhancement is not provided by corresponding lubricant compositions in which the viscosity improver is a similar polyolefin but which does not contain dispersancy substituents. Although the practice of this invention is not bound to any particular theory or explanation, it is believed that dispersant polyolefin VI improvers interact with overbased, oil-soluble, metal salt detergent in a manner which promotes viscosification. This may be due to interactions between colloidal particles of the detergent and polar functional groups of the VI polymer which result in chemical and/or physical crosslinking of VI polymer molecules. This would lead to a higher effective VI polymer molecular weight and consequentially higher viscosifying properties. Adding detergent would lead to increased crosslinking and viscosity up to when all the available functional groups on the VI polymer are used. The degree of crosslinking would then diminish with more detergent addition leading to a drop in the level of viscosity enhancement. This interaction can be inhibited or diminished if other additives, such as dispersant, which may competitively interact with the detergent such as by adsorption, are present when the VI improver and detergent are combined, resulting in lower viscosification properties.

The following examples illustrate some embodiments of this invention and are not intended to limit its scope. All percentages given in the disclosure and claims are in weight percent, unless otherwise stated.

EXAMPLES

Terms used in the examples have the following meanings:

| TERM | DESCRIPTION |
|---|---|
| Detergent A | An overbased calcium sulfonate detergent, having a base to sulfonate molar ratio of about 12:1 and a nominal TBN of 300, made from a mixture of 55% monoalkylaryl sulfonate and 45% dialkyl $C_{12}$ benzene sulfonate as described by Jao, J. C. and Joyce Witt, in "Solubilization of Methanol by Calcium Alkylarylsulfonates in Hydrocarbon Media", Langmuir, Volume 6, page 944 (1990). |
| Detergent B | A nominal 300 TBN calcium sulfonate, available as Lubrizol ® 6477 from Lubrizol Corp. |
| Detergent C | A nominal 300 TBN calcium sulfonate, available as Lubrizol ® 74 from Lubrizol Corp. |
| Detergent D | A nominal 300 TBN calcium sulfonate, available as E-611 from Ethyl Corp. |
| Detergent E | A nominal 300 TBN calcium sulfonate, available as WITCO ® C-300 from Witco Corp. |
| Detergent F | A nominal 300 TBN calcium sulfonate, available as AMOCO ® 9243 from Amoco Chemical Co. |
| Detergent G | A nominal 300 TBN magnesium sulfonate, available as WITCO ® M-300 from Witco Corp. |
| Dispersant A | Poly(isobutylene) succinimide made by reacting poly(isobutylene) succinic acid anhydride, having a number average molecular weight of about 2,000, with pentaethylenehexamine in a 1:2 molar ratio, respectively, followed by derivitizing by reaction with glycolic acid, formaldehyde and phenol, using the procedure described in U.S. Pat. No. 4,636,322 (Nalesnik), provided as a 50% solution in 100 P Pale Oil. |
| Dispersant Package A | An additive composition having 58.2% Dispersant A, 17.4% Detergent A, 13.2% zinc dithiophosphate antiwear agent, 4.5% amine antioxidant, 1.8% amine friction modifier, 0.9% copper antioxidant, 0.9% polymethacrylate pour point depressant, 0.1% deemulsifier, and 3.0% Lubricating Oil C. |
| Lubricating Oil A | Naphthenic base oil, available as N-100 Pale Oil from Texaco, Inc. |
| Lubricating Oil B | Paraffinic base oil, available as SNO-100 from Texaco, Inc. |

-continued

| TERM | DESCRIPTION |
|---|---|
| Lubricating Oil C | Paraffinic base oil, available as 100P Pale Oil from Texaco, Inc. |
| Lubricant Oil D | Poly(decene-1) base oil having a viscosity at 100° C. of 4 centistokes, available as EMERY ® 3004 from Quantum Chemical Corp. |
| VI Polymer A | VI improver polymer which is a random copolymer of about a 60:40 molar ratio of ethylene to propylene, having a number average molecular weight of about 80,000. |
| VI Polymer B | Dispersant VI improver polymer which is a random copolymer of about a 60:40 molar ratio of ethylene to propylene, having a number average molecular weight of about 80,000 and grafted with 0.8% maleic anhydride and N-phenyl-1,4-phenylenediamine on essentially each graft. |

Unless otherwise indicated, test results given in the examples use the following procedures:

CCS: Cold Cranking Simulator procedure determined by the American Society for Testing and Materials (ASTM) Method of Test D2602 and in the Society of Automotive Engineers (SAE) J300 standard procedures, given in centipoise.

CHSV: Cannon High Shear Viscosity which is the apparent viscosity of a lubricant composition sample determined from measurements of the relationship between pressure drop and flow rate through a capillary tube at 150° C., as described in the ASTM Method of Test D4624-86, given in centipoise.

KV: Kinematic Viscosity determined by ASTM Method of Test D445 for automatic viscosity measurements, given in centistokes.

Thickening Power: of a VI improver is the increase in viscosity, at a given temperature, for a lubricant composition containing the VI improver, as compared to the same lubricant without the VI improver.

EXAMPLES 1C-13

Lubricant with VI Improver/Detergent Premixes

These examples show how to make lubricant compositions of this invention using dispersant VI polymer and detergent premixes. The viscosities of lubricant compositions containing such additives are measured and compared with reference materials illustrating the enhanced viscosification properties provided by this invention. All viscosities for these and subsequent examples use the previously described test procedures, unless otherwise indicated.

In Example 1, the viscosity values of Lubricating Oil A are given in Table 1, for comparison. The even-numbered examples, from 2C to 12C, do not contain detergent and are provided for comparison with the corresponding and next higher odd-numbered examples containing detergent. The lubricant compositions, containing various concentrations and types of VI polymer and detergent combinations, are listed in Table 1.

In Examples 3C and 5, lubricant compositions are made by weighing 28.75 g. of a solution of about 13 weight percent of the designated VI polymer in Lubricating Oil A as solvent, 4.25 g. of Detergent A and 217.00 g. of Lubricating Oil A, into a 16 oz. (473 ml.) glass bottle and mixed for 24 hours at 80°-90° C. These mixtures have 1.5% VI polymer, 1.7% detergent and the balance Lubricating Oil A. In Example 2C and 4C, the procedure is repeated for Examples 3C and 5, respectively, but without detergent. The same procedure is used in Examples 6C through 9, except that the amount of viscosity improver is reduced to 1.1%, by using 21.25 g. of the VI polymer solution along with 224.5 g. of Lubricating Oil A.

In Examples 10C through 13, different blending procedures are shown. In Examples 10C and 11, a dilute blending procedure is used, characteristic of standard blending operations, in which the VI polymer and lubricant are mixed first, followed by the addition of the detergent. The blend is stirred and heated at 80°-90° C. for 24 hours, and then cooled and measured for viscosity properties. In Examples 12C and 13, a concentrated blending procedure is used in which VI polymer solution is mixed with a minimal amount of lubricant (45 g.). The detergent is added to the mixture which is heated and stirred at 80°-90° C. for about 16 hours, at which time the remaining lubricant (224.4 g.), is added and the final mixture stirred at 80°-90° C. for another 8 hours, followed by cooling and viscosity measurements.

The various compositions and viscosity measurements for Examples 1C through 13 are given in Table 1.

TABLE I

Examples 1C-13 Viscosity Analysis

| | Additives | | Viscosity | | | | |
|---|---|---|---|---|---|---|---|
| | | | KV | | | | CCS |
| Ex. | VI Polymer[a] | Detergent[b] | 40° C. | 100° C. | 150° C. | CHSV | −25° C. |
| 1C | None | None | 19.71 | 3.74 | 1.75 | 1.524 | 2,075 |
| 2C | A[c] | None | 61.7 | 10.14 | 4.43 | 3.04 | 3,500 |
| 3C | A[c] | A | 62.8 | 10.4 | 4.59 | 3.076 | 3,550 |
| % Viscosity Increase | | | 3% | 4% | 6% | 2% | 4% |
| 4C | B[c] | None | 60.6 | 9.92 | 4.26 | 3.062 | 3,300 |
| 5 | B[c] | A | 84.6 | 13.29 | 6.50 | 3.398 | 3,400 |
| % Viscosity Increase | | | 59% | 55% | 89% | 22% | 8% |
| 6C | A | None | 46.84 | 7.97 | 3.83 | 2.743 | 3,200 |
| 7C | A | A | 47.78 | 8.09 | 3.61 | 2.596 | 3,250 |
| % Viscosity Increase | | | 3% | 3% | −11% | −12% | 4% |
| 8C | B | None | 45.9 | 7.84 | 3.61 | 2.57 | 3,100 |
| 9 | B | A | 59.5 | 9.89 | 4.32 | 2.83 | 3,200 |
| % Viscosity Increase | | | 52% | 50% | 38% | 25% | 10% |
| 10C[d] | B | None | 45.9 | 7.84 | 3.61 | 2.57 | 3,100 |
| 11[d] | B | A | 61.0 | 10.34 | 4.39 | 2.80 | 3,050 |
| % Viscosity Increase | | | 58% | 61% | 42% | 27% | −5% |
| 12C[c] | B | None | 45.9 | 7.84 | 3.61 | 2.57 | 3,100 |
| 13[c] | B | A | 71.3 | 11.56 | 5.18 | 2.89 | 2,980 |

TABLE I-continued

| Examples 1C-13 Viscosity Analysis | | | | | | | |
|---|---|---|---|---|---|---|---|
| | Additives | | Viscosity | | | | |
| | | | KV | | | | CCS |
| Ex. | VI Polymer[a] | Detergent[b] | 40° C. | 100° C. | 150° C. | CHSV | −25° C. |
| % Viscosity Increase | | | 97% | 91% | 84% | 31% | −12% |

Notes to Table 1:
[a]1.1%, unless otherwise indicated
[b]1.7%, unless otherwise indicated
[c]1.5%
[d]using dilute blending procedure
[e]using concentrated blending procedure The results in Table 1 can be analyzed in terms of the relative Thickening Power provided by the various types and amounts of VI polymer solution, with or without detergent, and blending procedure. For example, the Thickening Power at 100° C. of the non-functionalized VI polymer solution in Example 2C is 6.4 (10.14 minus 3.74). The Thickening Power of the same polymer blended with detergent is 6.66 (10.4 minus 3.74), showing only a 4% increase in polymer thickening efficiency. This increase may simply be attributed to the detergent additive itself, as opposed to any significant interaction between the polymer and the detergent. However, the dispersant VI polymer solution in Examples 4C and 5 gives an increase in Thickening Power from 6.18 to 9.55 for the polymer-detergent blend, which is a 55% increase in polymer thickening efficiency. These interactions exhibit considerable stability under high shear conditions as indicated by the CHSV viscosity increase of 22% for interactions of the dispersant VI polymer solution combined with detergent. Preblending the VI polymer and detergent additives at 55° C. rather than 80°-90° C., gives similar viscosity enhancements for the dispersant polymer. No viscosity enhancement is observed for the non-functionalized polyolefin VI polymer. Increases in relative polymer thickening efficiency occur for the dispersant VI polymer regardless of the particular amount which is used. The amount of lubricant present during combination of the VI polymer and detergent effects the degree of viscosity enhancement. More concentrated blending procedures, using less lubricant, provide larger increases in polymer thickening efficiencies.

EXAMPLES 14C-25

Lubricant with VI Improver/Detergent Premixes and Dispersant

These examples describe preparation and analysis of lubricant compositions containing VI polymer and detergent combinations, or without detergent for comparison, with various concentrations of dispersant. Two different blending procedures are used. In Examples 15C, 18C, 21C and 24C, VI polymer is initially blended with lubricant, followed by addition of preblended detergent and dispersant. In Examples 14C, 17C, 20C and 23C, this procedure is repeated without detergent. In this procedure, 25.5 g. of a 13% solution of VI Polymer B in Lubricating Oil B and 266.4 g. of Lubricating Oil A are weighed into 16 oz. (473 ml.) glass bottle and mixed overnight at 85° C. After complete mixing, 8.10 g. of a blend of 5.10 g. of Detergent A and 3.00 g. of Dispersant A, or simply 3.00 g. of Dispersant A and 271.5 g of Lubricating Oil A in the reference examples without detergent, are added to give a mixture containing 1.0% dispersant. Similar mixtures are prepared having 2.0%, 3.0% and 4.0% dispersant by adding 6.00 g., 9.00 g. or 12.00 g. of Dispersant A, respectively.

In another blending procedure, the VI improver and detergent are initially blended and heated using a small amount of lubricant, followed by addition of the remaining lubricant and dispersant. In this procedure, 25.5 g. of a 13% solution of VI Polymer B in Lubricating Oil B, 45.0 g. of Lubricating Oil A and 5.10 g. of Detergent A are weighed into a 16 oz. (473 ml.) glass bottle and mixed overnight at 80°-90° C. Sufficient Lubricating Oil A and Dispersant A are then added to give 300 g. of solution containing 1.0%, 2.0%, 3.0% or 4.0% of dispersant. The mixtures all contain 1.1% VI polymer and 1.7% detergent, when present.

Viscosity measurements of these compositions are given in Table 2.

TABLE 2

| Examples 14C-25 Viscosity Analysis | | | | | | | |
|---|---|---|---|---|---|---|---|
| | Additives | | Viscosity | | | | |
| | | VI Improver/ | | KV | | | CCS at |
| Ex. | Dispersant | Detergent Premix | 40° C. | 100° C. | 150° C. | CHSV | −25° C. |
| 14C | 1% | —[a] | 49.16 | 8.10 | 3.56 | 2.584 | 3,300 |
| 15C | | No | 57.3 | 9.53 | 4.32 | 2.776 | 3,300 |
| 16 | | Yes | 61.7 | 9.98 | 4.30 | 2.830 | 3,400 |
| 17C | 2% | —[a] | 52.2 | 8.46 | 3.70 | 2.745 | 3,550 |
| 18C | | No | 57.9 | 9.46 | 4.07 | 2.849 | 3,550 |
| 19 | | Yes | 67.6 | 10.68 | 4.62 | 3.069 | 3,650 |
| 20C | 3% | —[a] | 55.5 | 8.83 | 3.83 | 2.789 | 3,750 |
| 21C | | No | 61.8 | 9.93 | 4.09 | 2.932 | 3,850 |
| 22 | | Yes | 74.5 | 11.58 | 4.94 | 3.042 | 3,650 |
| 23C | 4% | —[a] | 58.7 | 9.20 | 4.00 | 2.977 | 4,100 |
| 24C | | No | 63.2 | 10.01 | 4.30 | 3.036 | 4,150 |
| 25 | | Yes | 77.4 | 11.86 | 5.05 | 3.319 | 4,250 |

Note for Table 2:
[a]no detergent

Comparing the kinematic viscosities shown in Table 2, the VI polymer/detergent premixed composition generally gives higher viscosities than the corresponding VI polymer/detergent composition without premixing, which are both significantly higher than the viscosity of composition without detergent. As the amount of dispersant increases, the viscosities of the VI polymer/detergent premixed lubricant composition increase significantly beyond the corresponding composition without preblending, to levels that are 22.5%, 18.5% and 17.4% higher, at 40° C., 100° C. and 150° C. respectively. In contrast, the viscosities of the non-preblended VI polymer/detergent composition approach the viscosity of the composition without detergent. This indicates that the dispersant competitively interacts with detergent, negating interaction between detergent and VI polymer, thereby precluding the viscosity enhancement provided by VI polymer and detergent interaction.

The high shear viscosity results show a similar increase in viscosity for the preblended VI polymer/detergent composition as compared to the non-preblended composition and composition without detergent. In addition, despite significant increases in high temperature viscosities, low temperature viscosities are not undesirably increased by the preblended VI polymer/detergent composition which therefore have significantly enhanced overall lubricant performance.

EXAMPLES 24C-29

Fully Formulated Lubricant Compositions

These examples show the effect of preblending viscosity improver with detergent in fully formulated lubricant compositions. In Examples 25C and 26, VI polymer solution is blended with a typical dispersant-inhibitor (DI) additive package, using two different blending procedures. In Example 25C, a standard blending procedure is used by weighing 25.5 g. of a 13% solution of VI Polymer B in Lubricating Oil B and 241.35 g. of Lubricating Oil A into a 16 oz. (473 ml.) glass bottle and mixed overnight at 85° C. After complete mixing, 33.15 g. of Dispersant Package A is added to provide a formulation containing 1.1% VI polymer, 1.7% detergent and 6.5% dispersant and other additives, including antioxidant, antiwear agent, and so on as given previously. Example 24C is a control example using the same procedure as in Example 25C but without the dispersant package. In Example 26, the same composition is prepared as in Example 25C except that the VI polymer solution is preblended with the detergent by weighing 25.5 g. of a 13% solution of VI Polymer B in Lubricating Oil B, 45.0 g. of Lubricating Oil A and 5.10 g. of Detergent A into a 16 oz. (473 ml.) glass bottle and mixing overnight at 80°-90° C. After completing the preblending, 191.25 g. of Lubricating Oil A and 33.15 g. of Dispersant Package A, modified to have Lubricating Oil C in place of Detergent A, are added. In Examples 27C through 29C, Examples 24C through 26 are repeated, respectively, replacing the dispersant VI polymer with a non-functionalized VI polymer. Viscosity measurements of the lubricant compositions are given in Table 3.

TABLE 3

Viscosity Analysis of Fully Formulated Lubricant Compositions

| | Additives | | | Viscosity | | | | |
|---|---|---|---|---|---|---|---|---|
| | | | | KV | | | | CCS at |
| Ex. | VI Polymer | DI | VI Improver/ Detergent Premix | 40° C. | 100° C. | 150° C. | CHSV | −20° C. |
| 24C | B | None | — | 45.9 | 7.84 | 3.61 | 2.57 | — |
| 25C | B | A | No | 67.9 | 10.45 | 4.48 | 3.284 | 2,800 |
| 26 | B | A | Yes | 72.6 | 11.09 | 4.80 | 3.402 | 2,710 |
| % Viscosity Increase | | | | 22% | 25% | 34% | 15% | — |
| 27C | A | None | — | 47.08 | 8.06 | 3.55 | 2.43 | — |
| 28C | A | A | No | 65.1 | 10.25 | 4.45 | 3.224 | 2,820 |
| 29C | A | A | Yes | 65.0 | 10.24 | 4.37 | 3.271 | 2,770 |
| % Viscosity Increase | | | | 0% | 0% | −9% | 6% | — |

The viscosity values in Table 3 show significant improvements of from 15 to 34% by using VI improver/detergent premixes with dispersant VI polymer solution. No improvement in viscosities are observed for the non-functionalized VI polymer solutions.

EXAMPLES 30-33C

Fully Formulated Lubricant Compositions with Lower VI Polymer Concentrations These examples show the viscosity performance of fully formulated lubricant compositions containing lower concentrations of VI polymer preblended with detergent, as compared with corresponding compositions having more VI polymer but without preblending with detergent. In Examples 30 through 33, following the procedure in Example 26, lubricant compositions having 0.84%, 0.91%, 0.97% and 1.04%, respectively, of VI polymer B, are preblended with 5.1 g. of Detergent A and 45.0 g. of Lubricating Oil A overnight at 80°-90° C. Following preblending, 33.15 g. of modified Dispersant Package A are added along with sufficient Lubricating Oil A to give a lubricant composition having 1.7% detergent and 6.5-8.0% VI polymer solution. For comparison, the viscosities of Example 25C for corresponding lubricant composition having 1.1% VI polymer without preblending with detergent are given. Viscosity measurements are listed in Table 4.

TABLE 4

Viscosity Analysis of Fully Formulated Lubricant Compositions with Varying VI Improver Concentrations

| | | Viscosity | | | | |
|---|---|---|---|---|---|---|
| | | KV | | | | CCS at |
| Ex. | VI Polymer | 40° C. | 100° C. | 150° C. | CHSV | −20° C. |
| 29C | 1.1%[a] | 67.9 | 10.45 | 4.48 | 3.284 | 2,800 |
| 30 | 0.84% | 61.7 | 9.61 | 4.10 | 3.049 | 2,410 |
| 31 | 0.91% | 64.1 | 9.93 | 4.29 | 3.211 | 2,570 |
| 32 | 0.97% | 66.4 | 10.26 | 4.42 | 3.112 | 2,560 |
| 33 | 1.04% | 70.2 | 10.75 | 4.62 | 3.258 | 2,680 |

Note to Table 4:
[a]without preblending VI improver and detergent

The results in Table 4 show that preblending VI polymer d detergent improves thickening efficiencies such that functionally equivalent high temperature viscosities are provided by compositions having significantly lower VI polymer concentrations than corresponding non-preblended composition. The preblended compositions also provide significantly reduced low temperature viscosities as shown by the cold cranking viscosity reductions of up to 8.6% or more.

Lubricant compositions having preblended VI polymer and detergent therefore provide not only significant savings in the cost of the additives, while maintaining high viscosity performance, but also provide significant improvement in low temperature viscosity performance as compared to corresponding lubricant compositions made without preblending VI polymer and detergent.

EXAMPLES 34C–41C

Dilution Effects for VI Improver/Detergent Premixes

These examples show the effect that additional diluent oil has on dispersant VI polymer/detergent premixes. In Examples 34C through 37, 102.0 g. of a 13% solution of VI Polymer B in Lubricating Oil B is blended with from 0 to 80 g. of Lubricating Oil A as diluent, followed by blending with 3.0 g. of Detergent A. This premix is blended overnight at about 80° C. to enable complete mixing and interaction between the VI polymer and detergent. For comparison, the procedures are repeated in Examples 39C through 41C in the absence of detergent. The viscosity is measured using the previously described procedure and oil solubility observed, as shown in Table 5.

TABLE 5

Dilution of VI Improver/Detergent Premixes

| Ex. | Detergent | Diluent Oil (g) | Viscosity (KV at 100° C.) | Oil Solubility (at 80° C.) |
|---|---|---|---|---|
| 34C | A | 0 | —[a] | Insoluble |
| 35 | A | 20 | 3,926 | Poor |
| 36 | A | 40 | 1,804 | Soluble |
| 37 | A | 80 | 423 | Soluble |
| 38C | None | 0 | 1,039 | Soluble |
| 39C | None | 20 | 529 | Soluble |
| 40C | None | 40 | 311 | Soluble |
| 41C | None | 80 | 143 | Soluble |

Note for Table 5:
[a]too viscous to measure

The results in Table 5 show that a minimum level of lubricant is needed for solubility of the VI polymer and detergent premix. The comparative examples show that solubility is not a problem in the absence of premixing with detergent. As in previous examples, the premixing of dispersant VI polymer and detergent results in substantial viscosity increases.

EXAMPLES 42–66C

Diluent and Detergent Concentration Effects on Lubricant Viscosity

These examples show that enhanced lubricant composition viscosity is achieved over a wide range of diluent and detergent concentrations. In Examples 42–66C, 102 g. of a 13% solution of VI Polymer C in Lubricating Oil C is mixed with various amounts of Lubricating Oil A as diluent and blended to form a homogeneous mixture to which various amounts of Detergent A are blended at 80° C. overnight. Lubricant compositions containing 1.1% VI polymer are prepared and tested using the previously described viscosity procedures. In addition to Examples 42–62 using a range of detergent and diluent concentrations, Examples 63C 66C without detergent are presented for comparison. The various amounts of detergent and diluent, as well as viscosity properties, are shown in Table 6.

TABLE 6

Diluent and Detergent Concentration Effects on VI Improver/Detergent Premix Viscosification

| | Premix Amounts | | Viscosity[a] | | | |
|---|---|---|---|---|---|---|
| | | | KV | | CHSV | CCS |
| Ex. | Detergent A (g) | Diluent Oil (g) | 40° C. | 100° C. | 150° C. | −25° C. |
| 42 | 20.4 | 20 | 75.6 | 11.74 | 2.749 | 3,150 |
| 43 | 20.4 | 40 | 57.6 | 9.69 | 2.631 | 3,100 |
| 44 | 20.4 | 80 | 58.2 | 9.78 | 2.788 | 3,150 |
| 45 | 20.4 | 120 | 58.8 | 9.90 | 2.786 | 3,150 |
| 46 | 20.4 | 160 | 58.4 | 9.92 | 2.749 | 3,150 |
| 47 | 12.0 | 20 | 68.2 | 11.01 | 2.793 | 3,250 |
| 48 | 12.0 | 40 | 61.6 | 10.10 | 2.744 | 3,050 |
| 49 | 12.0 | 80 | 61.5 | 10.10 | 2.710 | 3,250 |
| 50 | 12.0 | 120 | 59.6 | 9.90 | 2.722 | 3,250 |
| 51 | 12.0 | 160 | 59.0 | 9.78 | 2.819 | 3,250 |
| 52 | 6.0 | 20 | 63.7 | 10.57 | 2.834 | 3,000 |
| 53 | 6.0 | 40 | 64.9 | 10.41 | 2.675 | 3,100 |
| 54 | 6.0 | 80 | 59.2 | 9.93 | 2.798 | 3,250 |
| 55 | 6.0 | 120 | 63.2 | 10.59 | 2.630 | 3,000 |
| 56 | 6.0 | 160 | 58.9 | 9.84 | 2.649 | 3,200 |
| 57 | 3.0 | 20 | 55.3 | 9.32 | 2.670 | 3,200 |
| 58 | 3.0 | 40 | 57.3 | 9.66 | 2.665 | 3,250 |
| 59 | 3.0 | 80 | 55.3 | 9.17 | 2.724 | 2,870 |
| 60 | 2.5 | 60 | 53.7 | 8.98 | 2.696 | 2,950 |
| 61 | 2.0 | 60 | 52.2 | 8.74 | 2.611 | 2,960 |
| 62 | 1.5 | 60 | 51.4 | 8.61 | 2.716 | 2,940 |
| 63C | 0 | 0 | 45.7 | 7.73 | 2.565 | 3,250 |
| 64C | 0 | 20 | 46.0 | 7.69 | 2.574 | 3,250 |
| 65C | 0 | 40 | 45.7 | 7.73 | 2.428 | 3,250 |
| 66C | 0 | 80 | 45.8 | 7.74 | 2.483 | 3,050 |

Notes to Table 6:
[a]of lubricant composition made with premix and added Lubricating Oil A to have VI polymer level of 1.1%.

The results in Table 6 show that enhanced viscosification of lubricant compositions is achieved using VI polymer/detergent premixes having a range of detergent and diluent concentrations. The results also show that measurable viscosity enhancement is shown for all detergent concentrations, with a leveling off in viscosity enhancement of, in these examples, of a VI improver to detergent ratio about 15%. Higher concentrations of detergent generally do not provide significant additional increases in viscosity enhancement and in some cases would be undesirable if excess detergent is used resulting in reduced storage stability due to undesirable increases in viscosity during storage.

EXAMPLES 67C–82

Lubricants having Various Detergents in VI Polymer/Detergent Premixes

These examples show that enhanced viscosification is achieved by VI improver/detergent premixes using a variety of detergents. Following the procedures used in Examples 42 through 66C, lubricant compositions are prepared using the type and amount of detergent and diluent, as well as viscosity analysis using the previously described procedures, as shown in Table 7.

TABLE 7

Lubricant Using Various Detergents in VI Improver/Detergent Premixes

| | | | Viscosity | | | |
|---|---|---|---|---|---|---|
| | | | KV | | CHSV | CCS |
| Ex. | Detergent (g) | Diluent Oil (g) | 40° C. | 100° C. | 150° C. | −25° C. |
| 67C | None | 40 | 45.7 | 7.73 | 2.428 | 3,250 |
| 68 | B 12.0 | 40 | 55.3 | 9.45 | 2.645 | 3,100 |
| 69 | 6.0 | 40 | 54.9 | 9.36 | 2.595 | 3,050 |

TABLE 7-continued

| Lubricant Using Various Detergents in VI Improver/Detergent Premixes | | | | | | |
|---|---|---|---|---|---|---|
| | Detergent | Diluent | Viscosity | | | |
| | | | KV | | CHSV | CCS |
| Ex. | (g) | Oil (g) | 40° C. | 100° C. | 150° C. | −25° C. |
| 70 | 3.0 | 40 | 52.8 | 8.83 | 2.644 | 3,050 |
| 71 | F 6.0 | 40 | 47.3 | 7.93 | 2.513 | 3,300 |
| 72 | 3.0 | 40 | 46.4 | 7.79 | 2.503 | 3,250 |
| 73 | G 12.0 | 40 | 50.3 | 8.36 | 2.601 | 3,300 |
| 74 | 6.0 | 40 | 50.0 | 8.29 | 2.519 | 3,250 |
| 75 | 3.0 | 40 | 49.4 | 8.22 | 2.647 | 3,300 |
| 76C | None | 100 | 45.8 | 7.72 | 2.510 | 3,250 |
| 77 | C 12.0 | 100 | 53.3 | 8.88 | 2.646 | 3,300 |
| 78 | 6.0 | 100 | 53.4 | 8.99 | 2.577 | 3,150 |
| 79 | D 12.0 | 100 | 54.2 | 9.07 | 2.713 | 2,620 |
| 80 | 6.0 | 100 | 52.1 | 8.73 | 2.613 | 2,820 |
| 81 | E 12.0 | 100 | 51.6 | 8.59 | 2.681 | 3,150 |
| 82 | 6.0 | 100 | 51.9 | 8.64 | 2.705 | 3,100 |

The results show that the amount of viscosity enhancement will vary depending upon the particular detergent, which may be calcium or magnesium compounds.

EXAMPLES 83-88C

Effect of Detergent Batch Variations on Viscosification using VI Improver/Detergent Premixes These examples show that viscosity enhancement occurs for a given detergent made using batch manufacturing regardless of batch variations. In Examples 83 through 87, 102 g. of a 13% solution of VI Polymer C in Lubricating Oil B and 100 g. Lubricating Oil A as diluent are blended to make a homogeneous mixture, followed by adding 3.0 g. of various product batches of Detergent A and blended at 80° C. overnight. Sufficient amounts of these premixes are combined with Lubricating Oil A to give a final composition having 0.88% VI polymer. Example 88C is presented for comparison in which the procedure in repeated without the detergent. Viscosity is measured using the previously described procedures with the results given in Table 8.

TABLE 8

| Effect of Detergent Batch Production on Viscosification Using VI Improver/Detergent Premixes | | | | | |
|---|---|---|---|---|---|
| | Detergent | Viscosity | | | |
| | | KV | | CHSV | CCS |
| Ex. | A | 40° C. | 100° C. | 150° C. | −25° C. |
| 83 | A-1 | 47.4 | 8.15 | 2.354 | 2,870 |
| 84 | A-2 | 46.8 | 8.00 | 2.406 | 2,930 |
| 85 | A-3 | 48.7 | 8.34 | 2.458 | 2,880 |
| 86 | A-4 | 45.2 | 7.74 | 2.281 | 2,570 |
| 87 | A-5 | 44.7 | 7.68 | 2.344 | 2,960 |
| 88C | None | 39.2 | 6.85 | 2.344 | 2,960 |

The results in Table 8 show consistent viscosity enhancement using a detergent product despite variations from batch manufacturing.

EXAMPLES 89C-91

Synthetic Lubricating Oils with VI Improver/Detergent Premixes

These examples show that VI improver/detergent premixes enhance the viscosity of lubricants containing synthetic lubricating oil. In Example 91, 200 g. of a 13% solution of VI Polymer B in Lubricating Oil B and 100 g. of Lubricating Oil B are blended at 50° C. followed by adding 6.0 g. of Detergent A and blending at 80° C. overnight to make a completely blended VI improver/detergent premix. The premix is then added to a synthetic Lubricating Oil D to give a lubricant containing 1.1% VI polymer. Corresponding lubricant composition free of detergent is prepared in Example 90C for comparison, as is Example 89C of only lubricating oil. The viscosities for these compositions are shown in Table 9.

TABLE 9

| VI Improver/Detergent Premixes in Synthetic Lubricating Oil | | | | | | | |
|---|---|---|---|---|---|---|---|
| | Additives | | Viscosity | | | | |
| | | | KV | | | CHSV | CCS |
| Ex. | VI Improver | Detergent | 40° C. | 100° C. | 150° C. | 150° C. | −25° C. |
| 89C | None | None | 16.81 | 3.86 | 1.88 | 1.412 | 480 |
| 90C | B | None | 33.89 | 6.93 | 3.24 | 2.215 | 660 |
| 91 | B | 3% A | 40.35 | 8.22 | 3.77 | 2.487 | 690 |
| % Viscosity Increase | | | 38% | 42% | 39% | 34% | — |

The results in Table 9, and as compared with Table 1, show that VI improver/detergent premixing enhances the viscosity of synthetic oil base stocks in addition to mineral oils. As with the mineral oil properties, improvements in higher temperature viscosities are achieved without any significant increase in low temperature viscosity.

DESCRIPTION OF FIGURES

FIGS. 1 through 4 show the properties, in graphic form, of detergent/VI improver premixes of this invention, and how such properties vary depending upon the type and amount of VI improver, detergent and dispersant.

More particularly, FIG. 1 plots the increase in kinematic viscosity, measured at 100° C., against the weight ratio of detergent to VI improver, for 8.5 weight percent VI improver, which is a 13 weight percent solution of VI polymer in Lubricating Oil A. The kinematic viscosities are measured over a range in weight ratio of detergent to VI improver for both dispersant VI polymer as compared with nondispersant VI polymer. The ratio of the kinematic viscosity of the compositions containing detergent/VI improver over the same composition without detergent is determined in terms of percent increase. The increases in kinematic viscosity are plotted along the ordinate or vertical axis of the graph with the weight ratio of detergent to VI improver plotted along the abscissa or horizontal axis. There is a large difference in viscosity performance between the two types of VI polymers. The addition of small amounts of detergent, from 1 to 5 weight percent, gives increases in kinematic viscosity of up to about 60 percent for the dispersant VI polymer. The nominal increase in kinematic viscosity for the nondispersant VI polymer may simply be the result of added detergent as distinct from any interaction between detergent and the VI polymer. The graph shows a significant increase in kinematic viscosity with the initial addition of detergent which levels off at higher detergent concentrations. This kind of performance is consistent with detergent-/VI polymer interaction up to a maximum which may correspond to the total number of available sites for interaction between the polymer and detergent, such that the further addition of detergent does not provide any further increase in detergent/VI polymer interaction.

FIG. 2 is similar to FIG. 1 except that the data shown is for Cannon High Shear viscosity, measured at 150° C., instead of kinematic viscosity. The results are similar to those in FIG. 1 in that substantial increases in relative viscosity are observed for the dispersant VI polymer only. This performance demonstrates the detergent/VI polymer interactions are maintained under high shear conditions, suggesting that such interactions are of a chemical rather than a physical nature.

FIG. 3 is similar to FIG. 1 except that the Cold Cranking Simulator (CCS) viscosity, measured at −25° C. is given instead of kinematic viscosity. The results show that there is no low temperature viscosity increase for dispersant VI polymers as compared to a gradual increase in viscosity for nondispersant VI polymer.

FIG. 4 shows the effect dispersant concentration has on viscosity for different premix combinations of VI polymer, dispersant and detergent. Increases in kinematic viscosity, such as described in FIG. 1, are plotted along the ordinate or vertical axis. Weight percent dispersant is plotted along the abscissa or horizontal axis. As described in Examples 14C through 25, kinematic viscosities, measured at 100° C., show different viscosity characteristics depending on the presence and premixing of detergent. The viscosity for the detergent-free composition, given by line A, shows a linear increase in viscosity with dispersant concentration. The viscosity for the detergent/VI polymer preblend also shows a linear increase in viscosity but at an enhanced level due to detergent/VI polymer interaction. In contrast, lubricant made by premixing dispersant and detergent, shown line B, shows lower viscosities when dispersant is provided. This may be due to strong and irreversible dispersant/detergent interaction which precludes detergent/VI polymer interaction. At constant detergent concentration, as dispersant concentration increases a saturation limit is reached beyond which viscosity increases without further blocking of detergent/VI polymer interaction.

We claim:

1. A process for making a lubricant composition by:

(1) combining:

(a) dispersant viscosity index polymer, which is a polyolefin of ethylene, $C_{3-20}$ α-monoolefin, and optionally polyene, having a number average molecular weight of at least about 10,000, which is grafted with ethylenically unsaturated, carboxyl-containing compound and dispersancy substituent, with;

(b) detergent, which is an overbased, oil-soluble, calcium sulfonate; to make a premix, followed by;

(2) combining the premix with lubricating oil and dispersant package to make a lubricant composition with enhanced viscosification.

2. The process of claim 1 wherein the viscosity index polymer has a repeating structure represented by the formula:

$$(-CH_2CH_2-)_a(-\overset{\overset{R}{|}}{C}HCH_2-)_b(-\overset{\overset{R_{ene}}{|}}{C}HCH_2-)_c(-\overset{\overset{R'}{|}}{C}H\overset{\overset{R_g}{|}}{C}H-)_d$$

wherein:

a is from about 15 to about 85 mole percent;

b is from about 15 to about 85 mole percent;

c is from 0 to about 15 mole percent;

d is from about 0.1 to about 15 mole percent;

each R is independently $C_{1-18}$ alkyl;

each $R_{ene}$ is independently $C_{2-30}$ hydrocarbenyl;

each R' is independently hydrogen, R or $R_{ene}$; and each $R_g$ is independently a carboxyl-containing hydrocarbylene and one or more $R_g$ contain dispersancy substituent.

3. The process of claim 2 wherein $R_g$ is aminoaromatic-substituted, amide-containing hydrocarbylene.

4. The process of claim 3 wherein $R_g$ is an N-arylphenyleneimido succinylene group.

5. The process of claim 1 wherein the detergent has a structure represented by the formula:

$$(M^{+v}(OH)_v)_m(M_3^{+v}{}_{-v}CO_3^{=})_n(M^{+v}Y_v^{-})$$

wherein:

$M^{+v}$ is calcium;

v is the valence of M of 2;

$Y^-$ is an oil-soluble, sulfonate anion; and m+n is more than 0.5.

6. The process of claim 5 wherein M m+n is from about 8 to about 12.

7. The process of claim 1 wherein solvent is present in step (1) providing a solution of viscosity index polymer and detergent.

8. The composition of claim 1 wherein the lubricant composition has a significantly increased kinematic and/or high shear viscosity as compared with the same lubricant composition made without precombining the viscosity index polymer and detergent in step (1).

9. The composition of claim 8 wherein the viscosity index polymer has a repeating structure represented by the formula:

$$(-CH_2CH_2-)_a(-\overset{\overset{R}{|}}{C}HCH_2-)_b(-\overset{\overset{R_{ene}}{|}}{C}HCH_2-)_c(-\overset{\overset{R'}{|}}{C}H\overset{\overset{R_g}{|}}{C}H-)_d$$

wherein:

a is from about 15 to about 85 mole percent;

b is from about 15 to about 85 mole percent;

c is from 0 to about 15 mole percent;

d is from about 0.1 to about 15 mole percent;

each R is independently $C_{1-18}$ alkyl;

each $R_{ene}$ independently is $C_{2-30}$ hydrocarbenyl;

each R' is independently hydrogen, R or $R_{ene}$; and each $R_g$ is independently a carboxyl-containing hydrocarbylene and one or more $R_g$ contain dispersancy substituent.

10. The composition of claim 9 wherein $R_g$ is aminoaromatic-substituted, carboxyl-containing hydrocarbylene.

11. The composition of claim 10 wherein $R_g$ is an N-arylphenyleneimido succinylene group.

12. The composition of claim 8 wherein the detergent has a structure represented by the formula:

$$(M^{+v}(OH)_v)_m(M_{3-v}{}^{+v}CO_3^{=})_n(M^{+v}Y_v^{-})$$

wherein:

$M^{+v}$ is calcium;

v is the valence of M of 2;

$Y^-$ is an oil-soluble, sulfonate anion; and m+n is more than 0.5.

13. The composition of claim 12 wherein m+n is from about 8 to about 12.

* * * * *